US007828521B2

(12) United States Patent
Bart

(10) Patent No.: US 7,828,521 B2
(45) Date of Patent: Nov. 9, 2010

(54) TURBINE MODULE FOR A GAS-TURBINE ENGINE

(75) Inventor: Jacques Rene Bart, Verrieres le Buisson (FR)

(73) Assignee: SNECMA, Paris (FR)

( * ) Notice: Subject to any disclaimer, the term of this patent is extended or adjusted under 35 U.S.C. 154(b) by 496 days.

(21) Appl. No.: 11/229,726

(22) Filed: Sep. 20, 2005

(65) Prior Publication Data

US 2007/0231133 A1 Oct. 4, 2007

(30) Foreign Application Priority Data

Sep. 21, 2004 (FR) ..... 04 52103

(51) Int. Cl.
*F01D 9/04* (2006.01)
*F01D 25/24* (2006.01)

(52) U.S. Cl. ..... 415/209.2; 415/209.3

(58) Field of Classification Search ..... 415/208.2, 415/209.1, 209.2, 209.3, 216.1; 416/244 A, 416/244 R See application file for complete search history.

(56) References Cited

U.S. PATENT DOCUMENTS

| | | | | | |
|---|---|---|---|---|---|
| 2,766,963 | A | * | 10/1956 | Zimmerman | 415/209.1 |
| 2,910,269 | A | * | 10/1959 | Haworth et al. | 415/173.6 |
| 3,295,751 | A | * | 1/1967 | Sceggel | 415/209.1 |
| 3,644,057 | A | | 2/1972 | Steinbarger | |
| 3,963,368 | A | | 6/1976 | Emmerson | |
| 4,483,054 | A | | 11/1984 | Ledwith | |
| 4,621,976 | A | * | 11/1986 | Marshall et al. | 415/191 |
| 4,730,982 | A | | 3/1988 | Kervistin | |
| 5,131,811 | A | | 7/1992 | Johnson | |
| 5,201,846 | A | * | 4/1993 | Sweeney | 415/173.6 |
| 5,288,206 | A | * | 2/1994 | Bromann et al. | 415/209.2 |
| 5,320,487 | A | | 6/1994 | Walker et al. | |
| 5,350,278 | A | | 9/1994 | Burge | |
| 5,470,524 | A | | 11/1995 | Krueger et al. | |
| 5,503,528 | A | | 4/1996 | Glezer et al. | |
| 5,616,003 | A | | 4/1997 | Charbonnel et al. | |
| 5,791,871 | A | * | 8/1998 | Sech et al. | 415/173.1 |
| 2002/0187046 | A1 | * | 12/2002 | Beutin et al. | 416/223 B |
| 2003/0206799 | A1 | * | 11/2003 | Scott | 415/209.3 |
| 2005/0025625 | A1 | | 2/2005 | Escure et al. | |
| 2006/0251520 | A1 | | 11/2006 | Bart | |

FOREIGN PATENT DOCUMENTS

| | | | |
|---|---|---|---|
| EP | 0 704 601 | A1 | 4/1996 |
| WO | WO 03/102379 | A1 | 12/2003 |

* cited by examiner

*Primary Examiner*—Edward K. Look
*Assistant Examiner*—Nathaniel Wiehe
(74) *Attorney, Agent, or Firm*—Oblon, Spivak, McClelland, Maier & Neustadt, L.L.P.

(57) ABSTRACT

A turbine module for a gas turbine engine includes at least an annular distributor and a turbine rotor inside a casing, where the annular distributor includes a plurality of elements in the form of a ring sector, of which a first part supports fixed blades positioned radially towards the turbine axis, and a second part forms a seal with the tips of the turbine rotor blades. The elements in the form of a ring sector are held inside the casing by attachment resources.

16 Claims, 4 Drawing Sheets

TURBINE MODULE FOR A GAS-TURBINE ENGINE

This present invention relates to the area of gas-turbine engines, and in particular deals with a modular turbine element for such an engine.

In the direction of flow of the gases, a gas-turbine engine includes the means for compressing the air feeding the engine, a combustion chamber, and at least one turbine stage to drive the air compression resources. In the aeronautical area, the engine can drive a fan that contributes to the thrust produced by the latter. The air entering the intake of the engine is then divided into a primary stream routed to the combustion chamber and a secondary stream, concentric to the first, and supplying the major part of the thrust in engines with a high dilution rate. In some cases, such engines include two bodies—a high-pressure body and a low-pressure body—which are independent in rotation from each other. The low-pressure body drives the fan. Each body includes a turbine module driving the associated compression module.

In longitudinal section, FIG. 1 shows the low-pressure turbine module of a double-bodied engine according to previous designs. The remainder of the engine is not visible in this figure. This module is placed downstream of the high-pressure stage whose flow of gas feeds out via the distributor 3 composed of blades that are fixed, individual or in sectors, mounted between the outer casing 5 and the fixed internal structure 7. The low-pressure turbine rotor 9 is composed of five disks 9A to 9E equipped with blades on their periphery and bolted together. The five stages are separated by fixed flow distributors 11A to 11D, each of which rectifies the flow of gas emerging from the upstream stage for the stage located immediately downstream.

In order to contain the gas stream in the channel traversing the turbine rotors, rings 13A to 13E are positioned concentrically to the blade structures of each stage. The rings 13A to 13 E are composed of sectors of plate that include the sealing segments 14, in material of the abradable type, which engage with the extremity of the rotor blades, here a claw fitted with radial blades, so as to form of the labyrinth type sealing joints.

The external casing includes axially oriented annular hooks 15, forming support and attachment surfaces both for the distributors 11 and the rings 13. Each distributor fin or sector includes corresponding resources on its head part. This is a pair of axial hooks 11' oriented upstream, and spaced radially in relation to each other, and axial hooks oriented downstream 11". The hooks 15 engage with the stator hooks in order to support, together, the distributors and the sealing rings. Metal elements forming springs are associated with anti-rotation plates, and are responsible for holding the parts together and maintaining the assembly.

Labyrinth joints also provide a seal between the rotor and stator elements at the other end of the stator fins. Thus in particular, rings, described as interstage rings, on which radial blades are machined, are mounted between two disks and bolted to them. These interstage rings engage with plates in abradable material brazed onto the internal platforms of the distributor. The interstage rings form a guidance channel for the cooling air between an internal supply source and the blade roots housed in their sockets, in dovetail form in particular, on the rim at the periphery of the disks.

The mounting of this turbine module is complex because of the number of parts involved in its structure.

It would therefore be desirable to create a module whose structure would result in easier assembly.

It would also be desirable to create a module in which the number of parts would be reduced, thus allowing easier mounting and simpler parts management.

It would again be desirable to reduce to a minimum the structural modifications to the turbine module according to the existing designs presented above, in order not to give rise to significant development.

The applicant has therefore set as an objective the creation of a turbine module, and more particularly of a low-pressure turbine module, whose structure is simplified in relation to the implementation of previous designs.

We are familiar, for example, with U.S. Pat. No. 5,899,660, which concerns a casing that allows the creation of turbine modules whose structure is simplified. The distributors form a single part with the sealing rings of the turbine rotors. The parts of the different stages are bolted to each other so that together they form a casing. However such a solution would involve a substantial modification of the structure of previous designs We are also familiar with U.S. Pat. No. 4,248,569 which concerns a stator mounting whose sealing ring forms a single part with the distributor, and that allows control of the play between the sealing ring and the tip of the rotor blades of the turbine. It does not appear that the solution presented would be applicable easily to a turbine module with several stages.

According to the invention, it is possible to attain the objectives sought, without the disadvantages of the previous solutions, with a turbine module for a gas turbine engine that includes at least an annular distributor and a turbine rotor inside a casing, where the annular distributor includes a variety of elements in the form of a ring sector, where a first part forms a platform and supports fixed blades positioned radially towards the turbine axis, and a second part forms a sealing resource with the tips of the turbine rotor blades. The module is characterised by the fact that the said elements in the form of a ring sector are fixed inside the casing by attachment resources.

By virtue of the solution of the invention, mounting of the turbine stages is effected in a simple and efficient manner without the need for substantial modification of the environment of this module in the engine.

According to another characteristic, the said attachment resources include an axial hook attached to the casing or to the said element, engaging with a pair of axial hooks attached respectively to the said element or the casing. Preferably, the attachment resource is composed of an axial hook attached to the casing, engaging with a pair of axial hooks attached to the said element in the form of a ring sector.

The module of the invention is not limited to a single turbine stage, but consists of at least two stages and preferably between three and six consecutive turbine rotor stages separated by distributors.

According to another characteristic, the module includes attachment resources on the upstream part of the said element in the form of a ring sector.

Advantageously, the attachment resource includes an axial hook of the casing engaging with a pair of axial hooks attached to the said element in the form of a ring sector, in such a way that the downstream end of a sealing ring sector of the rotor located upstream is held between them.

According to another particularly advantageous characteristic, at least two of the said turbine rotors form a monoblock assembly.

According to another characteristic, plates in abradable material are attached to the said second part of the element.

One non-limiting method of implementation of the invention will now be described with reference to the appended drawings, in which.

Figure 1:
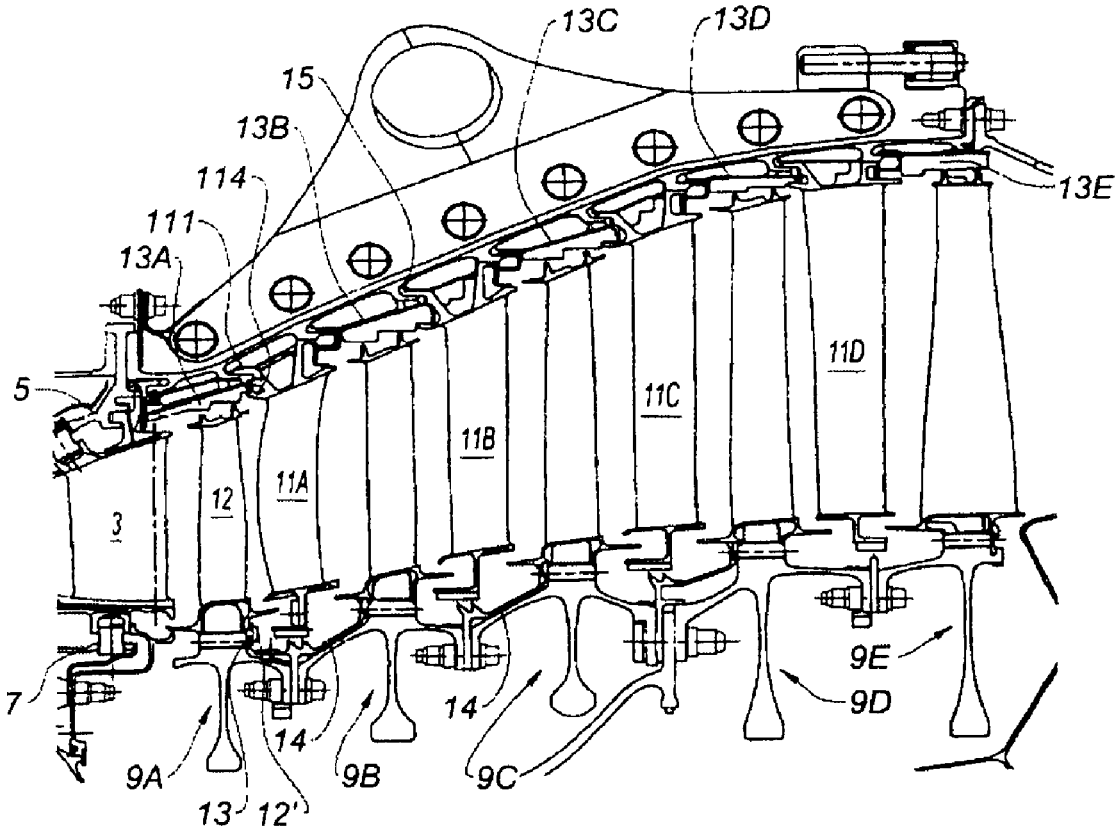
Fig. 1 PRIOR ART
FIG. 1 shows a turbine module of a gas-turbine engine according to existing designs.
Figure 2:
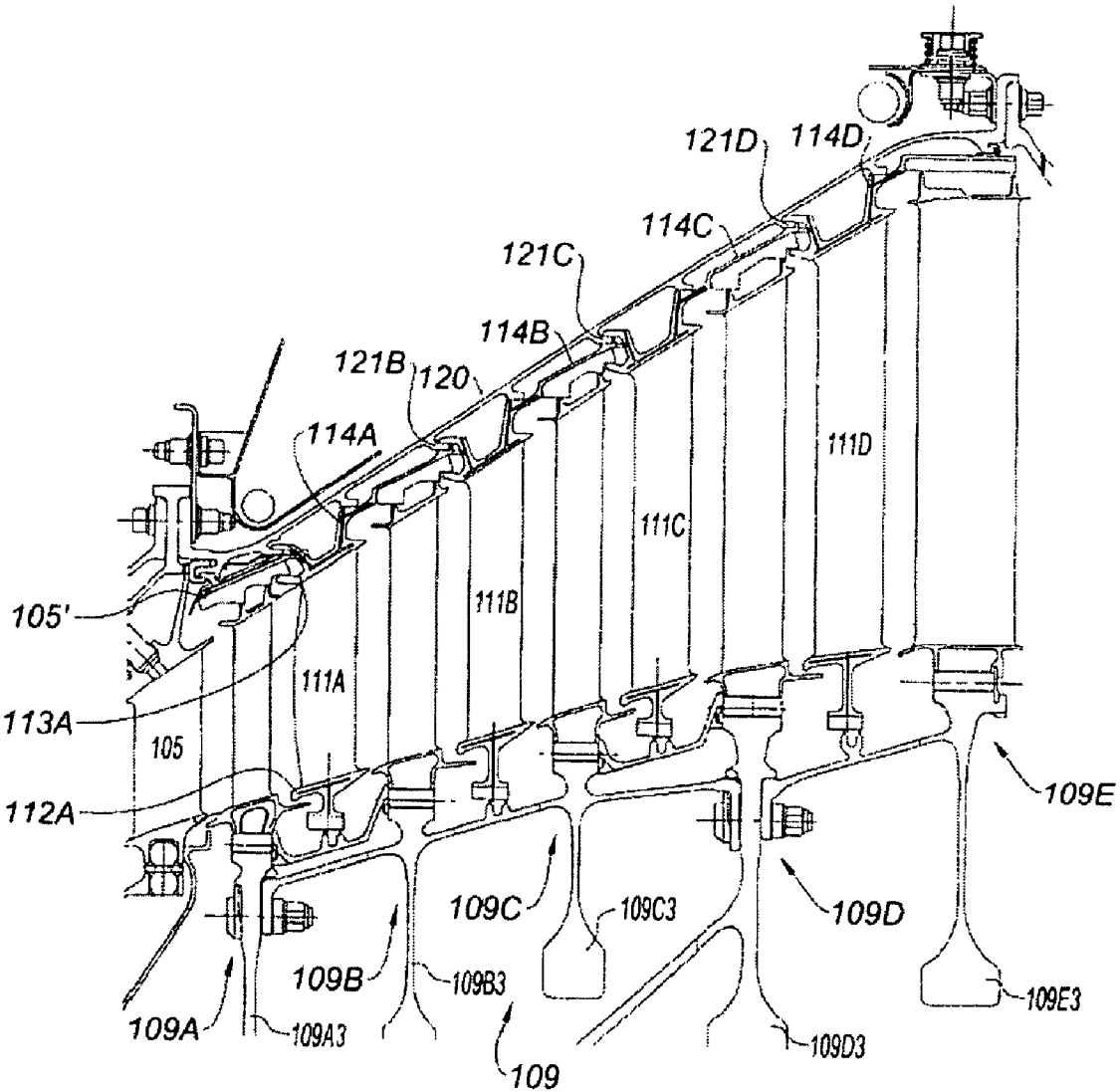
FIG. 2 shows the module according to the invention.

The module according to the invention shown in section along the axis of the gas-turbine engine, is placed downstream of the combustion chamber, not visible in FIG. 2. It receives the stream of engine gases via the distributor 105. It includes a casing of general tapered shape 120 within which are mounted the different distributor stages located between the turbine rotor stages. As in the device of previous design presented above, here the module includes five turbine stages 109A to 109E between which four distributors rings 111A to 111D are located.

Figure 3:
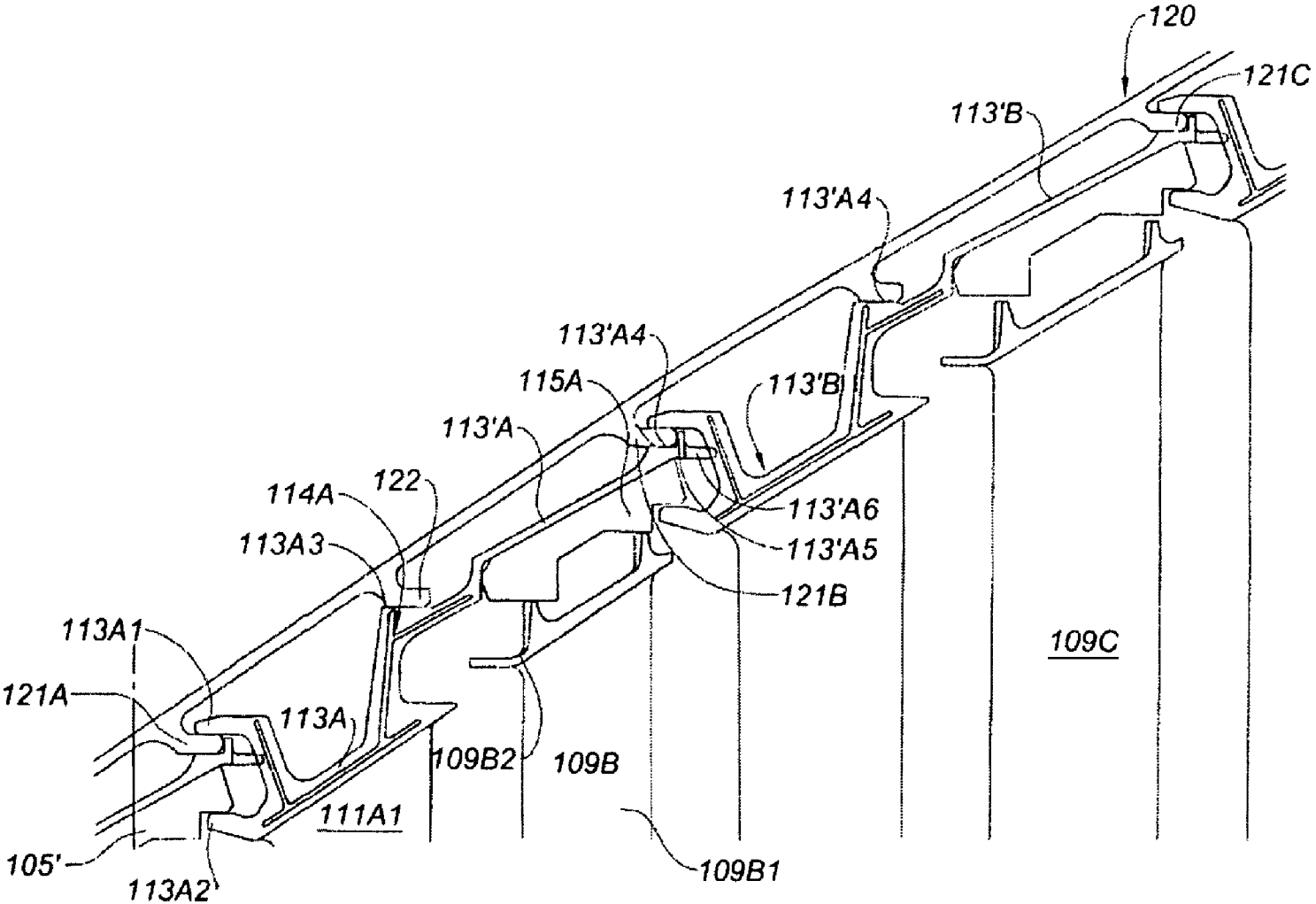
FIG. 3 shows an enlarged part of the stator of the module of FIG. 2
Figure 4:
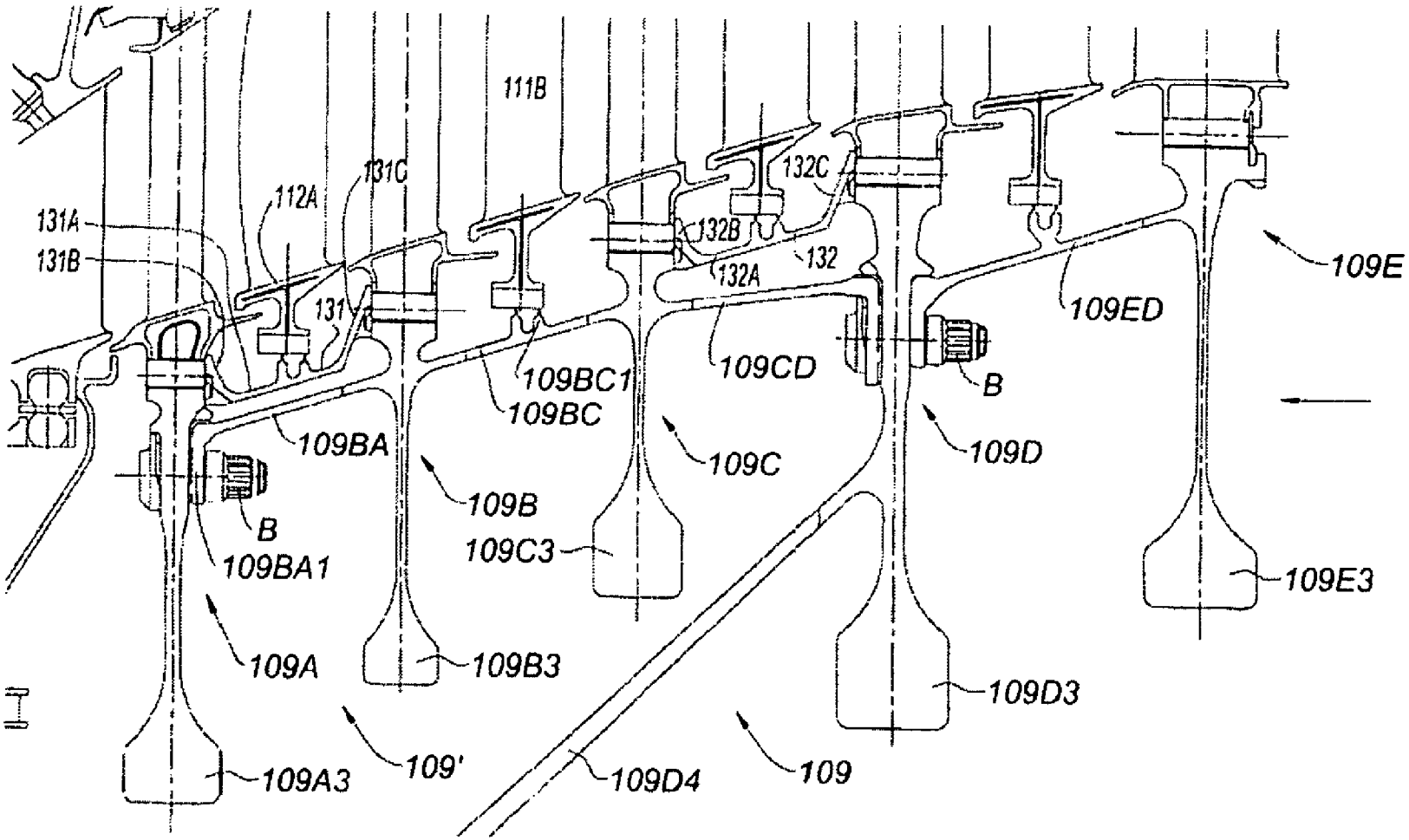
FIG. 4 shows an enlarged part of the rotor of the module of FIG. 2.

The distributor ring 111A is of generally annular shape, being subdivided into sectors. The sectors include from one to some ten fixed blades, possibly five or six. As an example, there may be 8 sectors forming the distribution ring. In the case of each sector of distributor 111A, one can distinguish (see FIG. 3 also for greater detail) the vane or vanes 111A1 located radially through the gas stream between an internal platform 112A located alongside the axis of the engine and an external platform 113A opposite.

According to the invention, the external platform 113A forms part of an element 114A in the form of a ring sector, in two parts that are located axially after each other. The said platform is the first part 113A, and a turbine sealing sector that fits together with the tip of the blades of the downstream turbine stage is the second part 113'A. Advantageously the internal platform 112A, element 114A, and the vanes are all formed from a single cast part The second part 113'A includes an abradable material 115A facing the wipers created at the tip of the blades of the corresponding mobile stage.

Upstream, the external platform 113A includes a pair of axial hooks 113A1 and 113A2 spaced radially in relation to each other. Downstream, it also has a radial support surface 113A3. Downstream, the second part 113'A includes a radial support surface 113'A4, and a radial lug 113'A5 forming an axial end-stop. One can also distinguish an axially-oriented finger 113'A6 which fits between two sectors of the downstream distributor 113B and forms an anti-rotation locking device.

On its inside surface, the casing 120 includes hooks distributed along the axis of the engine, and by which the stators are fixed.

In the figure, one can see an axial hook 121A that includes an outside radial support surface and an inside radial support surface. The spacing between two consecutive hooks 121A and 121B corresponds to the spacing between the hook 113A1 and the radial support surface 113'A4 of a given element 114. The lug 113'A5 rests axially against the hook 121B of the casing.

The pair of stator hooks 113A1 and 113A2 holds the casing hook 121A and the downstream end of the sealing sector 105' which is placed immediately upstream of the distributor ring 111A. For the stator 113B, the pair of hooks holds the assembly composed of the corresponding second hook 121B, the downstream end of the ring sector 113'A, and the plate 115A of abradable material.

The casing also includes end-stops forming radial support surfaces 122 between two consecutive hooks 121A and 121B. These provide radial support to the support surfaces 113A3.

The blades 109B1 of the stage 109B are terminated by a claw 109B2 which is equipped with wipers or radial blades that fit together with the plate in abradable material 115A. They thus form a labyrinth gasket against gas leakages between the two sides of the turbine rotor.

Here, the rotating assembly 109 is composed of five disks, 109B3 to 109E3 on which the blades are mounted. Each blade includes a root in the form of a bulb inserted in an axial socket of complementary shape, with a dovetail profile, for example, machined in the rim of the disks. The mobile blades and their assembly on a disk are familiar to the professional, and do not form part of the invention.

According to another characteristic of the invention, two disks together form a single block 109'. These are monoblock, meaning that they are not held together by mechanical means such as bolts, and are normally not removable. The two disks 109B3 and 109C3 are connected together by a ferrule 109BC. This ferrule has two circumferential wipers 109BC1 which are transverse to the axis of the engine, formed by machining on its surface facing towards the distributor ring 111B. Disk 109B3 is attached to a lateral ferrule 109BA. This includes a radial flange 109BA1 by which the rotor is bolted to the adjacent disk 109A3. Another bolt B is also shown. The orifices for the passage of the bolts are drilled in the plane of the disk close to the rim. Disk 109C3 also includes a ferrule 109CD with a radial flange 109CD1 by which it is bolted to disk 109D3. Disk 109E3 includes a ferrule 109ED with a radial flange by which it is bolted to disk 109D3. A cone 109D4 is attached to disk 109D3 for fitting the rotating assembly on a bearing (not shown).

To provide cooling for the root of the blades of stages 109B, 109C and 109D, air circuits are provided by means of interstage rings 131 and 132.

Ring 131 has a tapered part 131A with a diameter that is slightly larger than that of the ferrule 109BA to form an air passage with the latter. On each side, this has a tapered web 131B and 131C respectively, which presses against the disk 109A3 and 109B8 at the level of the root sockets. It thus forms both a means of guiding the air into the latter and an axial end-stop for the roots of blades located in them. The air enters from the interior of the rotor through passages created between the radial flange 109BA1 and the disk 109A3. It circulates between the two ferrules 109BA and 131A, and is then removed via the passages between the bottom of the socket and root of blade of the two disks 109A3 and 109B3 and fed into the gas channel.

Ferrule 132 likewise includes a central tapered part 132A which is edged with two webs 132B and 132C. The cooling air enters through passages created between bracket 109CD1 and disk 109D3, circulates between ferrules 132A and 109CD, from where it is guided to pass through the passages between the socket bottom and the blade root of disks 109C3 and 109D3, and then to the gas channel.

Mounting of the different components of the module is effected in the following manner.

The casing may possibly already be in place on the engine with the ring 105'.

The parts are then assembled in the following order:

The complete rotor 109A, whose blades are already mounted on the disk 109A3, is positioned and fixed by means of an appropriate tool.

The distributor ring 111A is mounted sector by sector by sliding the hooks 113A1 and 113A2 on the downstream part of the assembly formed by the ring 105' and the first hook 121A of the casing. Surface 113A3 rests against the first end-stop 122, and surface 113'A4 rests against the inside radial surface of the second hook 121B. Finger 113'A5 is butted up against the latter.

Inter-stage ring 131 is slid inside ring 111A until it comes up against the rotor 109A, thus axially locking the blade roots in their sockets. Hooks fitted to the root of the blades and bearing against the rim provide immobilisation against all axial movement in one direction. The ring provides axial lock in the opposite direction.

The monoblock body 109' with only the blades of stage 109B is positioned and bolted directly on disk 109A3. It can be seen that the blades of stage 109B rest against the web 131C of the inter-stage ring 131. The hooks on the blade roots are located on the upstream side resting against the rim of the disk, so that the roots are locked against all axial movement.

The distributor ring 111B is positioned sector by sector. The root of each sector is first introduced between the two disks 109B and 109C, and then the latter is rotated until it latches onto the second hook 121B of the casing, gripping the downstream end of the ring 113'A together with its abradable material. It is positioned on the casing in the same way as the preceding distributor. The radial downstream finger acts as an axial end-stop against the third hook 121C.

The blades of stage 109C are introduced into their housing on disk 109C3. The hook forming an axial stop element is located on the downstream side of disk 109C3, preventing all axial movement in the upstream direction.

Distributor 111C is mounted so that it adopts a position in the casing like the preceding distributors.

The inter-stage ring 132 is slid into the central passage created by distributor 111C. This rests against disk 109C3, locking the blades.

The complete rotor 109D is bolted onto the bracket 109CD1 of the monoblock 109'.

Distributor 111D is assembled.

The complete rotor 109E is bolted onto disk 109D3.

The above description of the assembly process demonstrates the advantages of the claimed module structure in relation to that of previous designs, which require many more operations, in particular because of the larger number of parts to be manipulated.

The invention claimed is:

1. A turbine module for a gas turbine engine comprising:

an annular distributor ring; and a turbine rotor inside a casing, wherein the annular distributor includes a plurality of elements in the form of a ring sector, of which a first part supports a plurality of fixed blades positioned radially between the first part and an internal platform, said first part includes a radially extending portion with a first radial support surface which abuts against a radial support of said casing, and a second part forms a seal with tips of turbine rotor blades, wherein said elements in the form of a ring sector are held inside the casing by first and second attachment units which attach said elements inside said casing, wherein said first attachment unit includes an axial hook attached to the casing and a pair of axial hooks attached to said one element, wherein said second attachment unit includes an axially oriented finger that fits between two sectors of another distributor located downstream of said annular distributor such that said axially oriented finger forms an anti-rotation locking device for said one element, wherein said plurality of fixed blades positioned radially between the first part and the internal platform, said first and second parts of said ring sector, and said internal platform are all formed of a single cast part thereby forming a modular element, wherein a first hook of said pair of axial hooks abuts said axial hook attached to the casing and a second hook of said pair of axial hooks abuts an abradable material of an adjacent element, wherein said first radial support surface is a free end of said radially extending portion which extends radially from said first part of said one element and is located downstream of said pair of axial hooks and upstream of said axially oriented finger, and wherein said second part of said one element extends downstream from said radially extending portion.

2. A module according to claim 1, comprising at least two consecutive turbine rotor stages separated by a distributor ring.

3. A module according to claim 1, wherein said first attachment unit is located upstream on the first part of said element in the form of a ring sector.

4. A module according to claim 1, wherein the first attachment unit includes said axial hook on the casing, engaging with said pair of axial hooks attached to said one element in such a way that a downstream end of a sealing ring sector of the rotor located upstream of said one element is held between the axial hooks.

5. A module according to claim 1, wherein at least two turbine rotors form a monoblock assembly.

6. A module according to claim 1, wherein plates of abradable material are attached to said second part of the element.

7. A module according to claim 1, wherein said distributor is positioned between two turbine rotor blades, wherein said two turbine rotor blades form a monoblock assembly.

8. A turbine module according to claim 7, wherein said monoblock assembly includes a monoblock ferule between said two turbine rotor blades, and wherein said monoblock ferule and said two turbine rotor blades form a single block welded together.

9. A turbine module according to claim 8, wherein said monoblock ferule includes at least one sealing lip oriented transversally with respect to an axis of said gas turbine engine and facing said distributor so as to form a seal with said distribution.

10. A module according to claim 1, wherein said ring sector comprises a second radial support surface which abuts against a second radial support of said casing, wherein said second radial support surface is located downstream of said first radial support surface and upstream of said axially oriented finger.

11. A module according to claim 10, wherein said ring sector further comprises a radial lug forming an axial end-stop, said radial lug being located downstream of said second radial support surface and upstream of said axially oriented finger.

12. A module according to claim 11, wherein a radius of said second radial support is greater than a radius of said first radial support, and the radius of said first radial support is greater than a radius of said axial hook attached to said casing.

13. A turbine comprising a plurality of modules connected to each other, each module being according to the module of claim 1.

14. A turbine according to claim 13, wherein said modules are connected to each other with axial hooks.

15. A module according to claim 1, wherein a radial position along said radially extending portion from which said second part of said one element extends downstream is closer to said first radial support surface than said fixed blade.

16. A turbine module for a gas turbine engine comprising:

an annular distributor ring; and a turbine rotor inside a casing, wherein the annular distributor includes a plurality of elements in the form of a ring sector, of which a first part supports a plurality of fixed blades positioned radially between the first part and an internal platform, and a second part forms a seal with tips of turbine rotor blades, wherein said elements in the form of a ring sector are held inside the casing by first and second attachment units which attach said elements inside said casing, wherein said first attachment unit includes an axial hook attached to the casing and a pair of axial hooks attached to said one element, wherein said second attachment unit includes an axially oriented finger that fits between two sectors of another distributor located downstream of said annular distributor such that said axially oriented finger forms an anti-rotation locking device for said one element, wherein said plurality of fixed blades positioned radially between the first part and the internal platform, said first and second parts of said ring sector, and said internal platform are all formed of a single cast part thereby forming a modular element, wherein a first hook of said pair of axial hooks abuts said axial hook attached to the casing and a second hook of said pair of axial hooks abuts an abradable material of an adjacent element, and wherein a downstream end of said second part of said one element includes a third axial hook that engages, with a fourth axial hook attached to said casing, into a second pair of axial hooks attached to a downstream element located downstream of said one element.

* * * * *